US006145957A

United States Patent [19]

Isobe et al.

[11] Patent Number: 6,145,957

[45] Date of Patent: Nov. 14, 2000

[54] SUCTION APPARATUS FOR INKJET PRINTING DEVICE

[75] Inventors: Shinji Isobe; Koichi Tanaka, both of Niigata, Japan

[73] Assignee: NEC Corporation, Tokyo, Japan

[21] Appl. No.: 08/943,142

[22] Filed: Oct. 3, 1997

[30] Foreign Application Priority Data

Oct. 3, 1996 [JP] Japan ..... 8-263234

[51] Int. Cl.[7] ..... B41J 2/165

[52] U.S. Cl. ..... 347/30

[58] Field of Search ..... 347/30, 29, 36; 417/42, 412, 472, 547, 466, 469

[56] References Cited

U.S. PATENT DOCUMENTS

| | | | |
|---|---|---|---|
| 5,389,961 | 2/1995 | Takagi | 347/29 |
| 5,570,116 | 10/1996 | Soga | 347/30 |
| 5,596,354 | 1/1997 | Murphy | 347/30 |
| 5,917,515 | 6/1999 | Nonoyama et al. | 347/30 |

FOREIGN PATENT DOCUMENTS

| | | |
|---|---|---|
| 0 622 200 | 11/1994 | European Pat. Off. . |
| 2-122940 | 5/1990 | Japan . |
| 4-37557 | 2/1992 | Japan . |
| 4-250043 | 9/1992 | Japan . |

OTHER PUBLICATIONS

"Patent Abstract of Japan" 57084887 (1982).

*Primary Examiner*—N. Le
*Assistant Examiner*—Judy Nguyen
*Attorney, Agent, or Firm*—Foley & Lardner

[57] ABSTRACT

A suction apparatus includes a volume-variable chamber having an inlet and an outlet which is formed by a plurality of enclosing parts including an elastic part. A slider applies a force to the volume-variable chamber to decrease the volume thereof and a valve applies a force to increase the volume thereof. When the slider decreases the volume, the valve opens the outlet to drain ink and air from the volume-variable chamber. When the valve increases the volume, the valve closes the outlet to produce a suction force.

7 Claims, 7 Drawing Sheets

SUCTION APPARATUS FOR INKJET PRINTING DEVICE

BACKGROUND OF THE INVENTION

1. Field of the Invention

The present invention generally relates to an inkjet printing system, and in particular to a suction apparatus which is used to clean an inkjet head.

2. Description of the Related Art

In general, an inkjet printing system is equipped with an ink suction apparatus which draws ink sludge within ink nozzles and bubbles trapped in an ink supply system by applying a suction force. Such a suction operation is periodically performed to avoid the deterioration of print quality.

A conventional suction pump has been disclosed in Japanese Patent Unexamined Publication No. 4-37557. The suction pump is provided with a piston performing a reciprocating motion in an inner cylinder and a piston valve which performs a reciprocating motion depending on the piston in a cylindrical space between the inner cylinder and an outer cylinder. The suction pump is further provided with an open/close valve and a pressure reducing means which is a space formed by the piston, open/close valve, and the open/close valve, the space varying in volume depending on the reciprocating motion of the piston. In other words, the pressure reducing means is arranged between the piston valve and the open/close valve. In the conventional suction pump like this, air is forced out of the pressure reducing means by pushing up the piston with the open/close valve closed and the piston valve open, and then a suction force is generated by pulling down the piston with the open/close valve open and the piston valve close.

However, the conventional suction pump needs the piston valve and the open/close valve in addition to the pressure reducing means, resulting in the increased number of parts and the complicated mechanism. This causes the increased weight and further the increased cost of the pump.

SUMMARY OF THE INVENTION

An object of the present invention is to provide a suction apparatus which can achieve high print quality with relatively simple arrangement.

Another object of the present invention is to provide a suction apparatus which can achieve weight reduction.

According to the present invention, a volume-variable chamber having an inlet and an outlet is formed by a plurality of enclosing parts including an elastic part. The suction apparatus is further provided with a member for applying a force to the volume-variable chamber to change a volume thereof, the member including a valve for opening the outlet when the member decreases the volume of the volume-variable chamber and closing the outlet when the member increases the volume of the volume-variable chamber.

Since the volume-variable chamber includes the elastic part, the suction force is produced by the member changing the volume with relatively simple arrangement and reduced weight. Further, since the member includes the valve, the suction mechanism is achieved with the reduced amount of hardware.

The suction apparatus may includes a driver for driving the member to change a volume of the volume-variable chamber such that the member is driven at a normal speed when the inkjet head is located at a home position thereof and at a relatively low speed when the inkjet head is not located at the home position.

DETAILED DESCRIPTION OF THE PREFERRED EMBODIMENT

Figure 1:
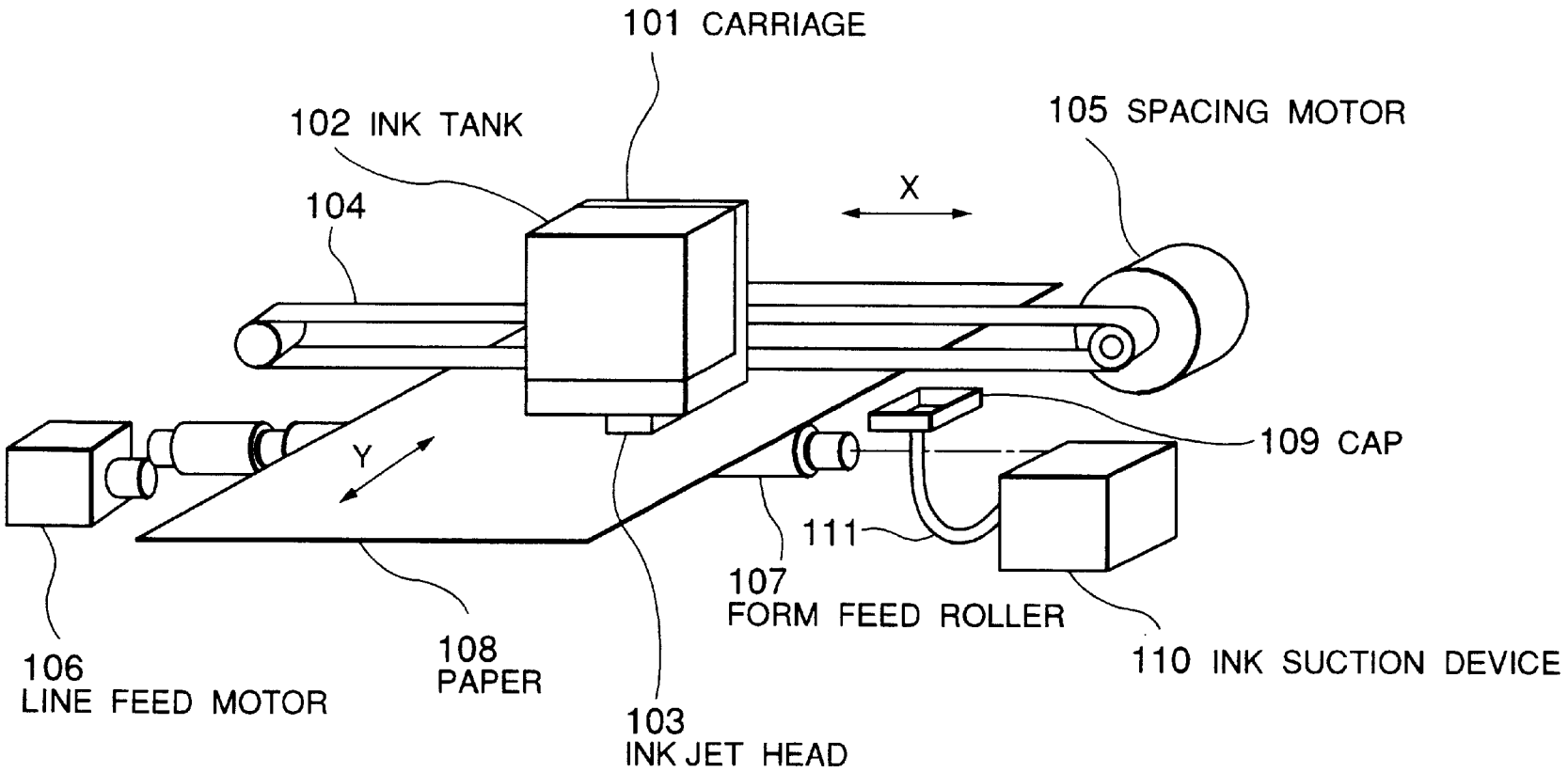
FIG. 1 is a perspective view showing an inkjet printing system employing an ink suction device according to the present invention.

Referring to FIG. 1, there is shown an inkjet printing system employing an ink suction device according to the present invention. A carriage 101 carrying an ink tank 102 and an inkjet head 103 is fixed to a driving belt 104 and performs a reciprocating motion in an X direction by a spacing motor 105. The inkjet head 103 having a plurality of ink nozzles therein ejects ink particles from selected ink nozzles according to print data. The inkjet head 103 may use piezoelectric devices or heaters. A line feed motor 105 drives a form feed roller 107 to move a recording paper 108 in a Y direction at right angles to the X direction.

The inkjet printing system is further equipped with a cap 109 connected to an ink suction device 110 through a suction pipe 111. The cap 109 is placed at a home position of the inkjet head 103 and comes in contact with the nozzle surface of the inkjet head 103 to draw ink sludge and bubbles as will be described hereinafter.

Figure 2:
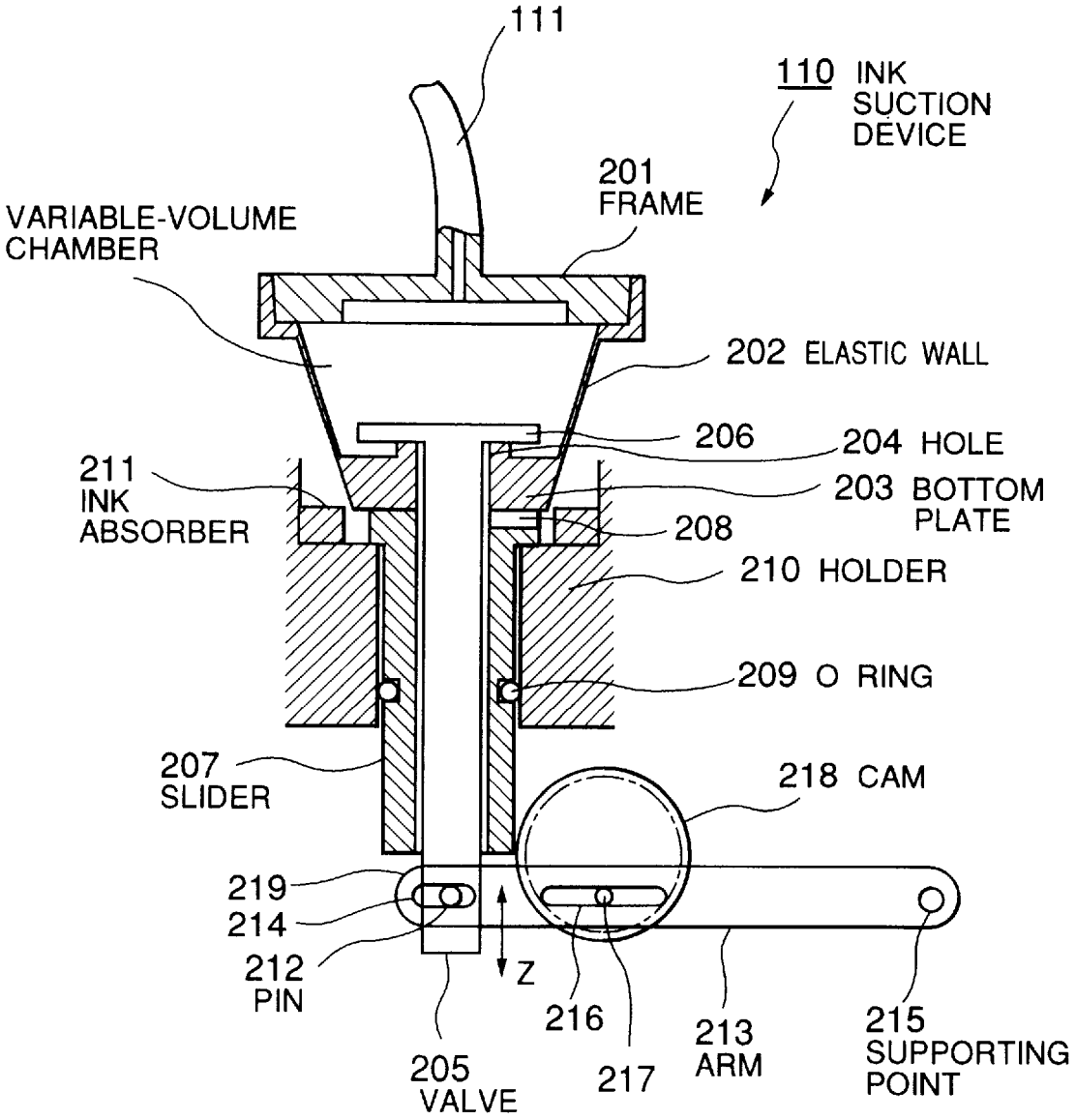
FIG. 2 is a cross-sectional view showing a ink suction device according to an embodiment of the present invention.

Referring to FIG. 2, the suction pipe 111 is connected to the suction hole of a frame 201 which is shaped like a disc. The frame 201, an elastic wall 202 and a bottom plate 203 are combined to form an inverted truncated cone chamber which is variable in volume due to the elasticity of the elastic wall 202. In this embodiment, the elastic wall 202 and the bottom plate 203 are made of elastic material such as rubber and are molded in one piece. However, since the elastic wall 202 is relatively thin and the bottom plate 203 is thick, the elastic wall 202 is deformed when a force is applied to the bottom plate 203 upwardly.

The bottom plate 203 has a hole 204 formed at the center thereof. The shaft of a valve 205 can slide through the hole 204 with creating clearance between them to allow air and ink to pass through. The valve 205 is provided with a top plate 206 which can open or close the hole 204. The shaft of the valve 205 can also slide through the hole of a hollow cylindrical slider 207 which is shorter than the shaft of the valve 205.

The cylindrical slider 207 has at least one groove 208 formed on the top surface of a flange thereof. The groove 208 allows the air and ink to be drained from the variable-volume chamber through the clearance between the hole 204 and the shaft of the valve 205 when the bottom plate 203 comes in contact with the slider 207 and the top plate 206 of the valve 205 is open.

The cylindrical slider 207 further has an O ring 209 fixed therein to slide in a hole of a holder 210 with frictional resistance. It is necessary to produce sliding frictional resistance which is sufficiently greater than the maximum recovery force of the elastic wall 202 when it is deformed. More specifically, in the case where the elastic wall 202 is made of silicone rubber, the elastic wall 202 produces a recovery force of about 50 g when it is deformed. Therefore, in the case where the volume inside the elastic wall 202 is set to the order of 2000 $mm^3$, the sliding frictional resistance produced by the O ring 209 is preferably set to 100 g to 200 g. If a sufficient frictional resistance is produced, another friction producing material would be used instead of the O ring 209. For example, rubber or molded resin may be used.

The cylindrical slider 207 is stopped sliding downward by the flange on which the groove 208 is formed. The valve 205 is stopped sliding downward by the bottom plate 203 which comes in contact with the cylindrical slider 207.

Further, an ink absorber 211 in the shape of a ring is provided on the holder 209 around the slider 207. The shaft of the valve 205 protrudes from the lower end of the slider 207 and has a pin 212 on the lower part thereof. The pin 212 is engaged in an oval hole 214 which is formed at an end of an arm 213. The arm 213 is rotatably supported by a supporting point 215. The arm 213 is further provided with another oval hole 216 in the center thereof in which a pin 217 of a cam 218 is engaged. Therefore, when the cam 218 rotates, the arm 213 performs a reciprocating motion in Z direction.

More specifically, when the arm 213 moves upwardly from a bottom dead point, the valve 205 also moves upwardly while sliding in the slider 207. Therefore, the top plate 206 rises from the opening of the hole 204 to provide a passage from the space inside the elastic wall 202 to outside through the groove 208. When a top end 219 of the arm 213 comes in contact with the bottom surface of the slider 207, the slider 207 starts sliding upwardly in the holder 210, which causes the bottom plate 203 to be pushed upwardly, resulting in deformation of the elastic wall 202. In other words, the volume inside the elastic wall 202 is reduced as the slider 207 slides upwardly with keeping the passage from the space inside the elastic wall 202 to outside through the groove 208.

Contrarily, when the arm 213 moves downwardly from a top dead point, the valve 205 first moves downwardly while sliding in the slider 207. Since the frictional resistance between the slider 207 and the holder 210 is greater than the recovery force of the deformed elastic wall 202, the slider 207 does not move until the top plate 206 of the valve 205 comes in contact with the bottom plate 203. When the top plate 206 of the valve 205 comes in contact with the bottom plate 203, the inside space of the elastic wall 202 is isolated from outside except for the cap 109. Thereafter, the valve 205 further moves downward to push both the bottom plate 203 and the slider 207 downward while the top plate 206 of the valve 205 blocks the opening of the hole 204.

Hereinafter, the flow of ink and air will be described referring to FIGS. 3A–3C.

Figure 3A:
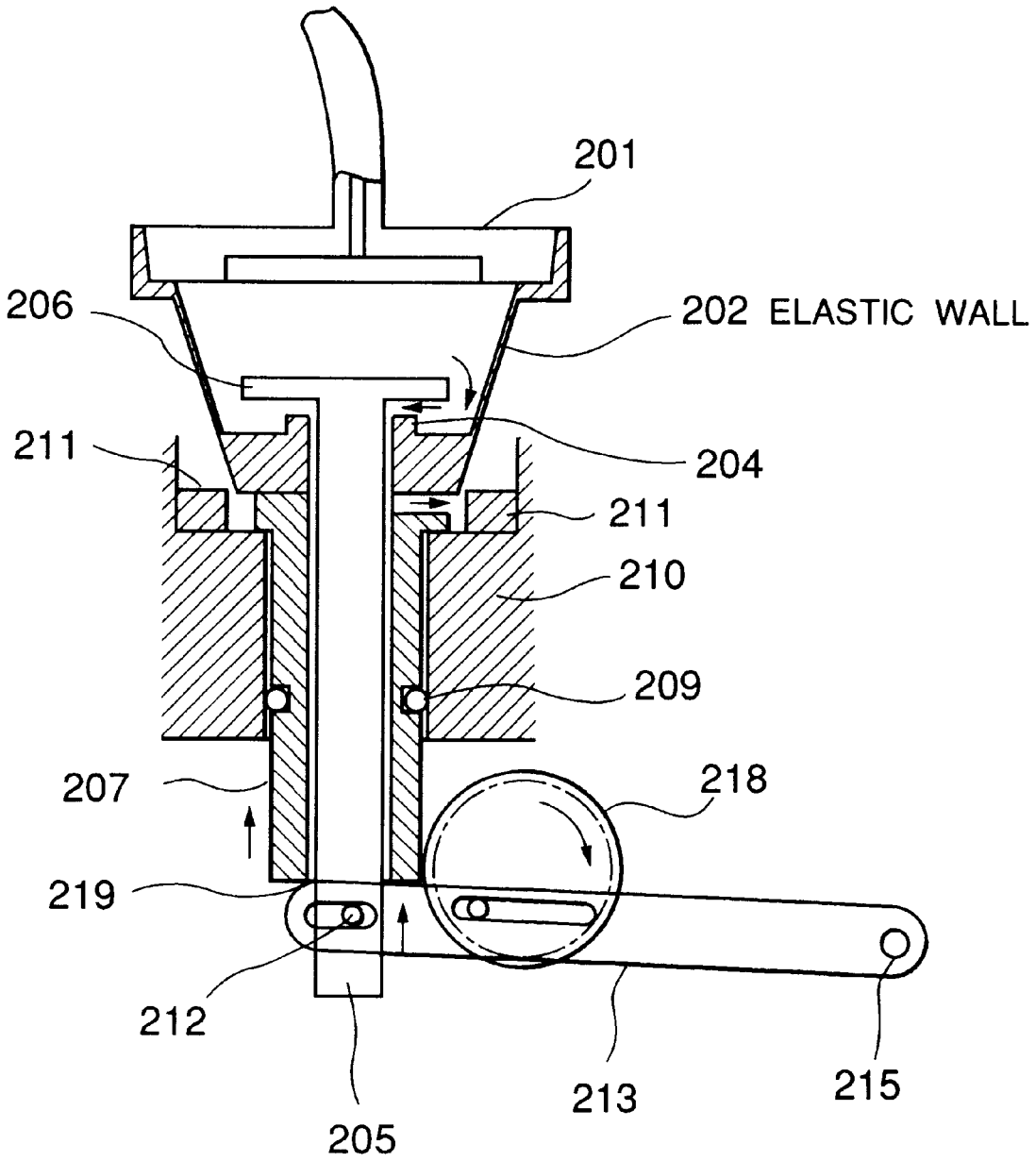
FIGS. 3A–3C are cross-sectional views showing a cycle of suction operation to explain an operation of the embodiment.

As shown in FIG. 3A, when the cam 218 rotates to move the arm 213 upwardly from a bottom dead point, as described above, the valve 205 is opened by the top plate 206 rising from the opening of the hole 204. Since there is a clearance between the shaft of the valve 205 and the bottom plate 203, the passage from the space inside the elastic wall 202 to outside through the groove 208 is created. In the open state of the valve 205, when the top end 219 of the arm 213 comes in contact with the bottom surface of the slider 207, the slider 207 starts sliding upwardly in the holder 210 and thereby the elastic wall 202 is deformed. This causes the air and the ink to be drained from the space inside the elastic wall 202 through the passage. The drained ink is absorbed by the ink absorber 211 surrounding the slider 207.

Figure 3B:
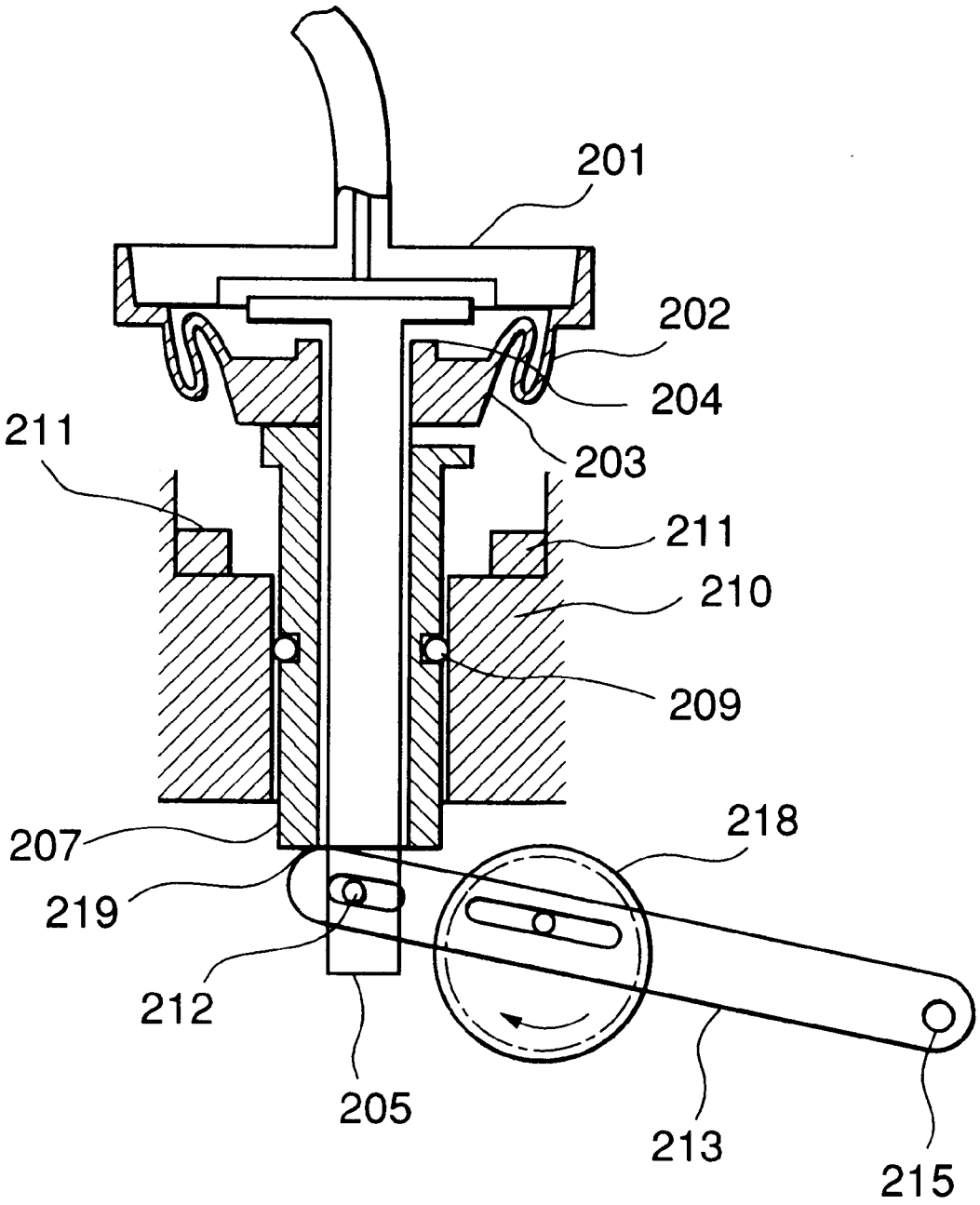

As shown in FIG. 3B, when the valve 205 reaches the top dead point, the volume of the space inside the elastic wall 202 is minimized. When the cam 218 further rotates, the valve 205 starts sliding downward to move the arm 213 downwardly from the top dead point.

Figure 3C:
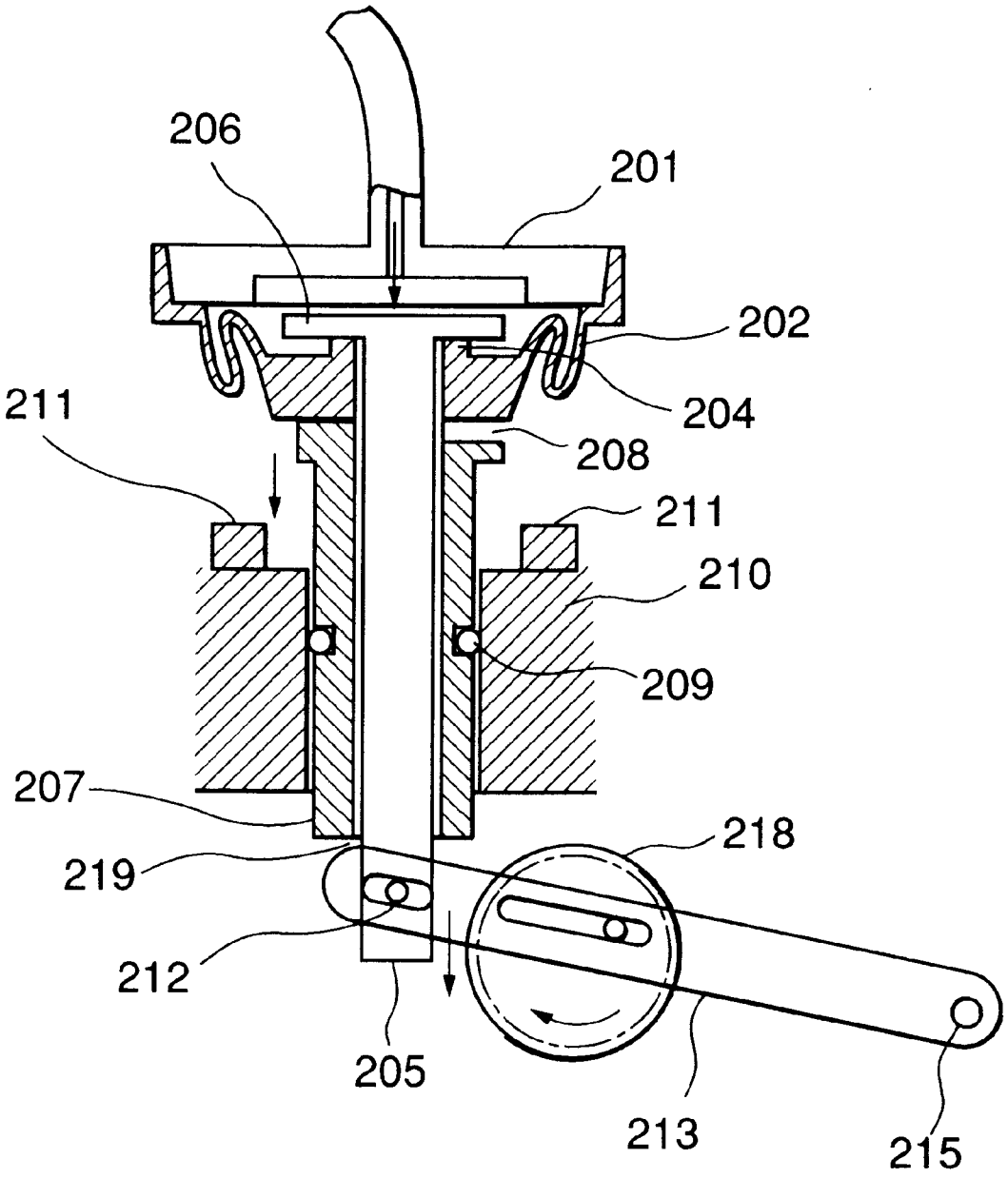

As shown in FIG. 3C, since the frictional resistance between the slider 207 and the holder 210 is greater than the recovery force of the deformed elastic wall 202, the slider 207 does not move until the top plate 206 of the valve 205 comes in contact with the bottom plate 203. When the top plate 206 of the valve 205 comes in contact with the bottom plate 203, the inside space of the elastic wall 202 is isolated from outside except for the cap 109. Thereafter, when the valve 205 further moves downward, the bottom plate 203 is pushed downward together with the slider 207. Therefore, the space inside the elastic wall 202 increases in volume while the valve 205 is closed, resulting in reduced pressure inside the elastic wall 202. In other words, the suction force is generated to draw ink and bubbles from the ink nozzles and the supply system and bubbles through the suction pipe 111. In this manner, a cycle of suction operation as shown in FIGS. 3A–3C is repeated as the cam 218 rotates.

Figure 4:
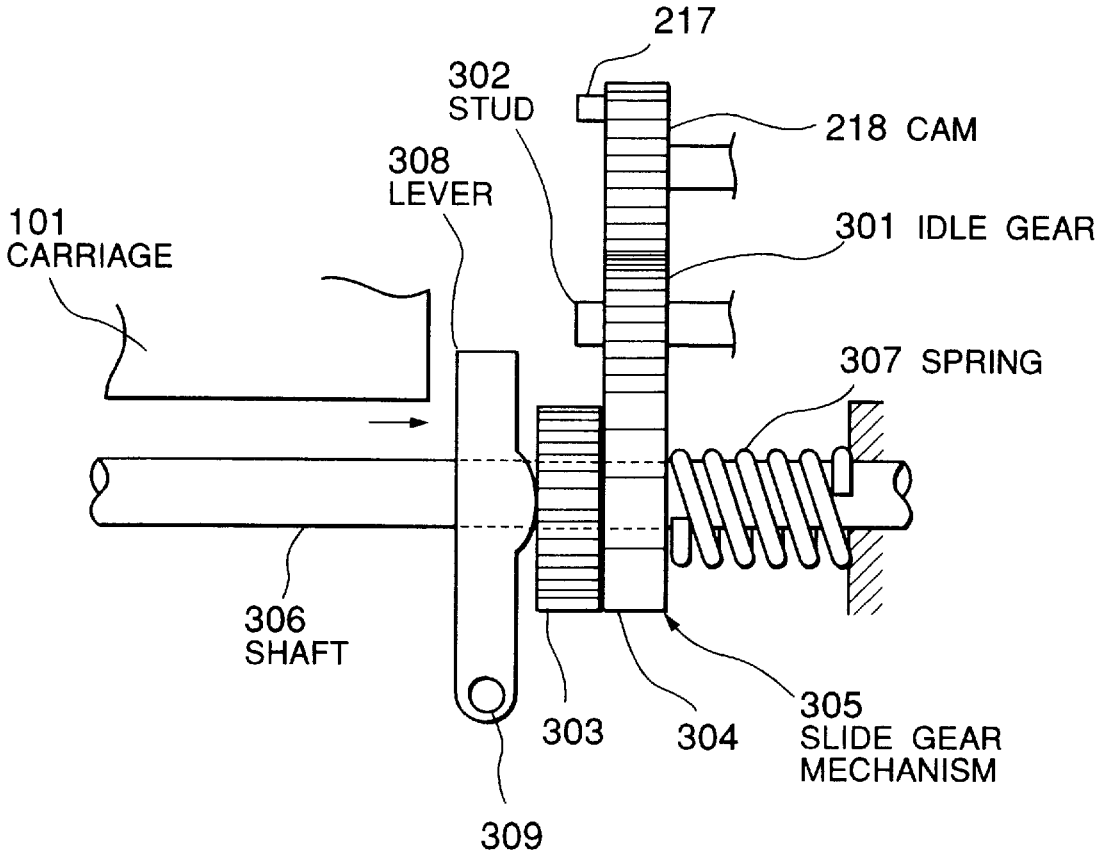
FIG. 4 is a side view showing an arrangement of cam driving mechanism in the embodiment.

Referring to FIG. 4, the cam 218 is engaged with an idle gear 301 which is rotatably supported by a stud 302. The idle gear 301 is in turn engaged with a selected one of a normal gear 303 and a selected-tooth gear 304 by a slide gear mechanism 305. In the slide gear mechanism 305, the normal gear 304 and the selected-tooth gear 305 can both slide along a shaft 306 and are rotated by the shaft 306 which is driven by the line feed motor 106. Therefore, the cam 217 is rotated by the line feed motor 106. The normal gear 304 and the selected-tooth gear 305 are both energized toward the carriage 101 by a spring 307 and are stopped sliding by a lever 308 which is rotatably supported by a stud 309. The lever 308 is pushed toward the spring 307 by the carriage 101 returning to its home position.

More specifically, when the carriage 101 leaves the cap 109, the lever 308 shifts toward the carriage 101 due to the spring 307 so that the idle gear 301 is engaged with the selected-tooth gear 304. Contrarily, when the carriage 101 returns to the home position, the carriage 101 pushes the lever 308 toward the spring 307 to cause the normal gear 303 to be engaged with the idle gear 301. Therefore, the suction operation is performed at a normal speed when the carriage 101 comes in contact with the cap 109. On the other hand, while the carriage 101 traversing, the suction operation is performed at much lower speed.

Figure 5:
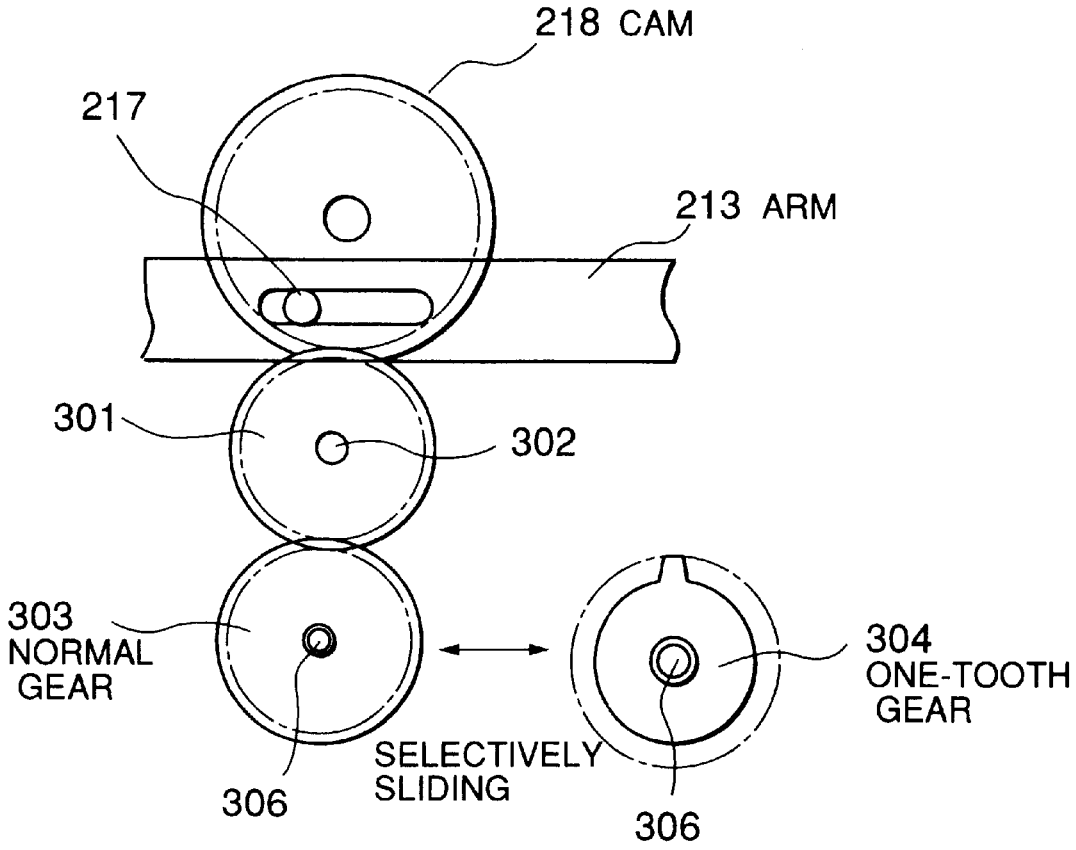
FIG. 5 is a schematic diagram showing an operation of the cam driving mechanism as shown in FIG. 4.

Referring to FIG. 5, in the case where the selected-tooth gear 305 has only one tooth, a turn of the shaft 306 causes the cam 218 to be rotated in steps when the selected-tooth gear 305 is selected. Therefore, the suction operation is performed very slowly while the carriage 101 is not located on the cap 109, preventing the ink from solidifying in the ink suction device 110 to ensure the normal operation and, at the same time, the long life time can be achieved.

What is claimed is:

1. A suction apparatus for sucking ink from an inkjet head, comprising:

a cap for making contact with the inkjet when the inkjet head is located at a home position;

a chamber having an inverted truncated cone shape with an elastic side wall, the chamber including an inlet at a top part thereof and an outlet hole at a bottom part thereof, wherein the inlet is connected to the cap;

a sleeve disposed outside the chamber and in contact therewith, the sleeve being movable in a first direction to deform the chamber;

a rod disposed within the sleeve and through the outlet, the rod having a seal that is disposed within the chamber and movable in the first direction to open the outlet hole and in a second direction to close the outlet hole and restore the chamber toward an original shape thereof; and a reciprocating drive mechanism which is coupled with the rod to drive the rod in the first and second directions, and, in various positions, is in contact with the sleeve to drive the sleeve in the first direction.

2. The suction apparatus according to claim 1, wherein the sleeve has a port through which the ink that is removed through the outlet hole is dispelled.

3. The suction apparatus according to claim 2, further comprising an ink absorber arranged on the housing adjacent the port to absorb the ink dispelled through the port.

4. The suction apparatus according to claim 1, wherein the chamber includes a fixed upper wall and a movable bottom wall, and the outlet hole is formed on the movable bottom wall.

5. The suction apparatus according to claim 1, wherein the reciprocating drive mechanism drives the rod at a normal speed when the inkjet head is located at the home position and at a lower speed when the inkjet head is not located at the home position.

6. The suction apparatus according to claim 5, wherein the reciprocating drive mechanism comprises a gear change mechanism.

7. The suction apparatus according to claim 1, wherein the ink is removed through the outlet hole when the outlet hole is opened and the sleeve is driven in the first direction and the ink is sucked when the outlet hole is closed and the rod is driven in the second direction.

* * * * *